US010730734B2

(12) United States Patent
Brey et al.

(10) Patent No.: US 10,730,734 B2
(45) Date of Patent: Aug. 4, 2020

(54) DEVICE FOR FILLING A CONTAINER WITH A CARBONATED FILLING PRODUCT

(71) Applicant: KRONES AG, Neutraubling (DE)

(72) Inventors: Christian Brey, Neutraubling (DE); Sebastian Baumgartner, Neutraubling (DE)

(73) Assignee: KRONES AG, Neutraubling (DE)

( * ) Notice: Subject to any disclaimer, the term of this patent is extended or adjusted under 35 U.S.C. 154(b) by 127 days.

(21) Appl. No.: 15/580,255

(22) PCT Filed: Sep. 30, 2016

(86) PCT No.: PCT/EP2016/073419
§ 371 (c)(1),
(2) Date: Dec. 6, 2017

(87) PCT Pub. No.: WO2017/055545
PCT Pub. Date: Apr. 6, 2017

(65) Prior Publication Data

US 2018/0222739 A1 Aug. 9, 2018

(30) Foreign Application Priority Data

Sep. 30, 2015 (DE) ..... 10 2015 116 577

(51) Int. Cl.
*B67C 3/00* (2006.01)
*B67C 3/26* (2006.01)

(52) U.S. Cl.
CPC ..... *B67C 3/262* (2013.01); *B67C 2003/2657* (2013.01)

(58) Field of Classification Search
CPC ..... B67C 3/262; B67C 3/065; B67C 3/2617; B67C 3/28; B67C 2003/2657; B67C 2003/2654
See application file for complete search history.

(56) References Cited

U.S. PATENT DOCUMENTS 2,870,798 A * 1/1959 Suelling ..... B67C 3/262 141/48
3,626,996 A 12/1971 Bingham et al.
4,089,353 A * 5/1978 Antonelli ..... B67C 3/08 141/302
5,413,153 A 5/1995 Zwilling et al.
(Continued)

FOREIGN PATENT DOCUMENTS

DE 29513031 9/1996
FR 1283986 2/1962
(Continued)

*Primary Examiner* — Reinaldo Sanchez-Medina
(74) *Attorney, Agent, or Firm* — Haynes and Boone, LLP

(57) ABSTRACT

A device for filling a container with a carbonated filling product in a beverage filling system is described. The device includes a gas valve for supplying a gas into the container, the gas valve being biased by a gas valve spring in a specified switch state, and a filling valve for supplying the filling product into the container, the filling valve being biased by a filling valve spring in a specified switch state. The gas valve and the filling valve are operatively connected to a common actuator for switching between an open and a closed switch state, and the gas valve spring applies a spring force which differs from that of the filling valve spring.

17 Claims, 3 Drawing Sheets

(56) References Cited

U.S. PATENT DOCUMENTS

| | | | | |
|---|---|---|---|---|
| 6,109,483 | A * | 8/2000 | Wilke | B67C 3/262 141/192 |
| 2005/0199314 | A1* | 9/2005 | Ruble | B65B 39/004 141/146 |
| 2013/0299044 | A1 | 11/2013 | Jenne | |
| 2014/0360624 | A1* | 12/2014 | Clusserath | B67C 3/001 141/91 |
| 2015/0274332 | A1* | 10/2015 | Gai | B67C 3/262 141/311 R |
| 2017/0057801 | A1* | 3/2017 | Clusserath | B67C 3/04 |
| 2017/0203945 | A1* | 7/2017 | Buchik | B67C 3/06 |

FOREIGN PATENT DOCUMENTS

| | | |
|---|---|---|
| WO | WO 2007/016958 | 2/2007 |
| WO | WO 2015/018633 | 2/2015 |

* cited by examiner

DEVICE FOR FILLING A CONTAINER WITH A CARBONATED FILLING PRODUCT

CROSS REFERENCE TO RELATED APPLICATIONS

This application is a national stage of International Application No. PCT/EP2016/073419, filed Sep. 30, 2016, which claims priority from German Patent Application No. 10 2015 116 577.5 filed on Sep. 30, 2015 in the German Patent and Trademark Office, the disclosures of which are incorporated herein by reference in their entirety.

BACKGROUND

Technical Field

The present invention relates to a device for filling a container with a carbonated filling product in a beverage filling system, comprising at least one gas valve for supplying a gas into the container for rinsing and/or pre-pressurizing the container for filling, and a filling valve for switching the flow of filling product into the container.

Related Art

When a container is filled with a carbonated filling product, the container is normally rinsed with a gas, then pre-pressurized with a pressurization gas. After filling, the pressure in container is relieved and returned to ambient pressure, in order for the container then to be conveyed to a capper. Pre-pressurization of the container is particularly necessary in filling systems for carbonated beverages, to prevent the release of $CO_2$ from the fill product during the filling process, and thus to prevent excessive foaming. For the pre-pressurization and filling, the container is connected with the filling valve in a gas-tight manner, for example by means of a centering bell.

Gas lines and gas valves must therefore be provided in order to supply gas to the containers for the processes described above, and convey gas away from the containers. The gas valves are normally provided in their own valve block, and each comprises its own actuators and its own control, for which suitable supply lines must be provided.

The provision of the actuators and controls that are needed for the gas valves adds to the overall complexity of the filling system.

SUMMARY

The present disclosure describes an improved device for filling a container with a carbonated filling product.

A device for filling a container with a carbonated filling product in a beverage filling system is described, including a gas valve for supplying a gas into the container, said gas valve being biased by a gas valve spring in a specified switch state, and a filling valve for supplying the filling product into the container, said filling valve being biased by a filling valve spring in a specified switch state, wherein the gas valve and the filling valve are operatively connected to a common actuator for switching between an open and a closed switch state. The gas valve spring applies a spring force which differs from that of the filling valve spring.

The spring forces can in particular differ if the spring constants, designs and/or preloads of the gas valve spring and the filling valve spring differ from each other. This results from, among others, the fact that, in idealized form, the spring force exerted by a spring is proportional to its displacement and its spring constant. The preload can accordingly be adjusted via the displacement. The spring force that is applied can also be varied by means of springs which differ from each other in their designs, for example by the combination of two springs with differing spring constants, the combination of two springs with differing lengths, and/or the combination of two identical springs.

By means of the application of differing spring forces, it is possible for the action of an actuator to have differing effects on the gas valve and the filling valve, so that although the actuator and the stroke applied by the actuator are common to both valves, the switching of the gas valve and the filling valve can be caused to occur at different points in time.

For example the spring force, in particular the spring constant and/or the preload, of the gas valve spring can be in a relationship to the spring force, in particular the spring constant and/or preload, of the filling valve spring such that a force applied by the actuator, which is exerted on both the gas valve spring and the filling valve spring, has the effect that one valve is in an open switch state and the other valve is in a closed switch state. Thus the spring force, in particular the spring constant and/or preload, of the gas valve spring, and the spring force, in particular the spring constant and/or preload, of the filling valve spring can be in a relationship to each other such that, as an effect of a force applied by the actuator, only the gas valve is initially in an open switch state. Such a combination of switch states, in which the gas valve is in the open switch state and the filling valve is in the closed switch state, is for instance required during a pre-rinsing and/or pre-pressurization of the container with a gas.

Accordingly, during the pre-rinsing and pre-pressurization of the container, gas can flow through the open gas valve into the container while the filling valve remains closed. The pre-rinsing of the container with gas serves to provide a defined atmosphere, and for example to reduce the proportion of oxygen in the container. The pre-pressurization of the container serves to establish a filling counter-pressure in the container.

The application by the gas valve spring of a spring force that differs from that applied by the filling valve spring can be achieved by the gas valve spring having a different spring constant from that of the filling valve spring. Additionally, or alternatively, the application of differing spring forces can be achieved by a difference in the preloading of the gas valve spring and the filling valve spring, i.e. a difference in the extent to which they are displaced in a rest state. Thus if the gas valve spring and the filling valve spring are differently preloaded, they can also have identical spring constants.

Differing spring forces can also be exerted by means of the gas valve spring and/or the filling valve spring having at least two spring components, and being, in some embodiments, formed from at least two springs with the same spring constant, differing spring constants and/or differing lengths.

In one embodiment, the gas valve spring biases the gas valve in an open switch state, and/or the filling valve spring biases the filling valve in an open switch state. Accordingly, in order to close the gas valve and/or the filling valve, it is necessary to apply a force to the gas valve spring and/or the filling valve spring. If no force is applied by the actuator to the gas valve spring and/or the filling valve spring, i.e. the actuator is in a passive switch state, the gas valve and/or the filling valve is in an open switch state. This has the advantage that, in the event of an outage of the actuator, or a cessation of the force applied by the actuator to the springs, the gas valve and/or the filling valve always adopts the open switch state. By this means it is possible, despite the outage of the actuator, to drain fill product that remains in the filling element, and clean and/or sterilize the filling element. Accordingly, cleaning or sterilization of the filling element does not require the actuator to be operational.

If a force from the actuator acts on the springs, which are connected in series, the spring which exerts the lesser spring force deforms first. Only after the freedom of movement of the spring with the lesser spring force is exhausted does the spring with the greater spring force begin to compress or extend due to the force applied by the actuator. If the force from the actuator is subsequently reduced, the spring with the greater spring force extends or compresses first. Only when the spring with the greater spring force has completed a maximum possible spring displacement, due to the reduction of the force from the actuator, does the spring with the lesser spring force also begin to extend or compress.

In certain embodiments, the gas valve and the filling valve are mechanically connected in series. Thus the drive sides of the filling valve and the gas valve are connected in series with each other. By this means it is possible for the gas valve spring to form a mechanical series connection together with the filling valve spring.

By means of a mechanical series connection of the gas valve and the filling valve, it can be brought about that, by the application of a force from the actuator on the series connection, initially only the filling valve or the gas valve is closed. Closing of the second valve to be closed does not take place until the displacement by the actuator of the spring of the first valve to close has been exhausted.

Conversely, for example, either the gas valve or the filling valve can be initially reopened, with the opening of the second valve to be opened not taking place until the first valve to open has reached its maximum possible spring displacement.

In several embodiments, the spring force, in particular the spring constant and/or preload, of the gas valve spring is greater than the spring force, in particular the spring constant and/or preload, of the filling valve spring. By this means a closing sequence and an opening sequence of the gas valve and/or the filling valve are established. In particular when the gas valve and the filling valve are connected in series, it is possible for the switch states of the gas valve and the filling valve to differ according to the switch state of the actuator.

The greater spring force of the gas valve spring has the result that, when the actuator acts on the gas valve spring and the filling valve spring, which are connected in series, it is initially the filling valve spring, with the lesser spring force, which undergoes a spring displacement. Only when the filling valve spring can deform no further, for example because the valve cone of the filling valve is accommodated in a sealing manner in a valve seat of the filling valve, does the gas valve spring begin to deform due to the force from the actuator.

If the force applied by the actuator to the gas valve spring and the filling valve spring is then reduced, the filling valve spring, with the lesser spring force, cannot perform a spring return displacement until the gas valve spring, with the greater spring force, has completed its own maximum spring return displacement.

Accordingly, it is possible for the gas valve to switch between an open switch state and a closed switch state without changing the switch state of the filling valve. By this means it is for example possible to pre-rinse and pre-pressurize a container, wherein the gas valve can be opened and closed both for pre-rinsing the container and for pre-pressurizing the container, with the filling valve remaining in a closed switch state.

In certain embodiments, the actuator is a double-stroke actuator, for example, a pneumatic double-stroke actuator. By this means it is possible to apply two forward strokes or two return strokes to the gas valve spring and the filling valve spring. For example the relative spring forces, in particular the spring constants and/or the preloads, of the gas valve spring and the filling valve spring can be designed such that a first forward stroke results in the closing of only the filling valve. The gas valve is closed only on the second forward stroke of the double-stroke actuator. Conversely, the first return stroke causes only the gas valve to open. The filling valve can then be opened by the second return stroke.

Alternatively, the first forward stroke can initially effect the closing of the gas valve, and the second forward stroke can effect the closing of the filling valve. Conversely, the first return stroke causes only the filling valve to open. The gas valve is only finally opened with the second return stroke.

The pneumatic design of the double-stroke actuator is expedient because compressed air is already provided at the filler for other functions, such as for example the raising and lowering of a lifting plate. In addition, a pneumatic double-stroke actuator has the advantage that, in the event of an outage of the actuator due to the loss of compressed air in the actuator, the gas valve spring and the filling valve spring can adopt their rest positions, in which the gas valve spring and the filling valve spring are normally open.

In some embodiments, a first return stroke of the actuator opens the gas valve fully. It is thereby possible, by means of a switch state of the actuator, to hold the gas valve in an open switch state, while the filling valve remains in a closed switching state. The switching state of a closed gas valve and simultaneously an open filling valve is required particularly for the pre-rinsing and pre-pressurizing of a container.

In other embodiments, the actuator is a single-stroke actuator, for example a pneumatic single-stroke actuator. The actuator therefore has only a single drive to control the gas valve and the filling valve. In this case the relationship between the spring forces, in particular the spring constants and/or the preloads, of the gas valve spring and the filling valve spring, must be chosen such that both the gas valve and the filling valve are closed by a forward stroke of the single-stroke actuator.

Because additional forces act on the filling valve, and in particular the filling valve cone, such as for example the force of the weight of the filling valve cone and/or an overpressure in the interior space of the valve originating from the filling product, it is possible by means of the single-stroke actuator to switch the gas valve between an open and a closed switch state separately from the filling valve.

In various embodiments, the filling valve spring possesses a spring force, in particular by means of the adjustment of an applicable spring constant and/or preload, which is greater, generally slightly greater, than the force of the weight of a filling valve cone. By this means it is possible to hold the filling valve in a closed switch state despite a prior return stroke of the single-stroke actuator. The force of the weight of the filling valve cone, in combination with the overpressure in the interior space of the valve, thereby counteracts the filling valve spring, so that the filling valve cone is pressed against a valve seat of the filling valve.

If, after a return stroke of the single-stroke actuator is completed, the overpressure in the interior space of the valve is fully relieved, the filling valve spring lifts the filling valve cone out of the valve seat, and the filling valve is thereby switched to the open switch state.

In all, the return stroke of the single-stroke actuator represents only the basic precondition for the adoption by the filling valve of an open switched state. After the return stroke of the single-stroke actuator is completed, the switching of the filling valve to the open switch state depends on the relationship between the spring force of the filling valve spring, the force of the weight of the filling valve cone, and the pressure in the interior space of the filling valve.

In several embodiments, a filling product outlet aperture disposed below the filling valve is in fluid communication with a rinsing valve, via a rinsing channel for rinsing the container.

By this means it is possible to rinse a container which pressed in a gas-tight manner into a centering bell, prior to the filling process, with a gas, for example $CO_2$. The gas, which originates for example from a gaseous phase of a filling product reservoir, is fed to the container via the open gas valve. In order to rinse the container with the gas, the rinsing valve is opened so that the gas issuing from the gas valve flows through the container and subsequently escapes through the rinsing channel, which leads to the rinsing valve.

If the rinsing valve is closed while gas continues to flow through the opened gas valve into the container, a pressure equalization is established between the interior of the container and the interior space of the valve, so that in the interior space of the valve there is no longer an overpressure pressing the filling valve cone against the filling valve seat. Accordingly, the closure of the rinsing valve leads to the removal of the pressure gradient at the filling valve cone, and thereby to the opening of the filling valve.

In certain embodiments, the actuator is a proportional actuator, for example, a spindle actuator. By this means it is possible to adjust the gas valve and the filling valve steplessly or stepwise between an open switch state and a closed switch state. Switch states are thereby also possible in which the gas valve and/or the filling valve is only partially open.

By this means it is possible via the gas valve to adjust the gas supply in line with the requirements. In addition, the flow rate by which the filling product flows into the container through the filling valve can be controlled to meet the requirements. Thus it is, for example, advantageous at the beginning of the filling process to fill the container slowly, in order to avoid the filling product foaming in the container. After the initial filling stage, the flow rate of the filling product can be increased. Shortly before the end of the filling process, for example when filling an area of the container in which its cross-section tapers, or shortly before a maximum fill height is reached, the flow rate of the filling product can again be reduced. Thus the proportional actuator enables adjustment of the gas supply and the filling product supply to the container that is to be treated. The filling process can thereby be more easily adjusted to differing container geometries.

In certain embodiments, the gas valve is displaceably disposed relative to a filling valve seat in order to close the filling valve. This can be used, by an application of force by the actuator on the gas valve, to switch the filling valve, in particular to close it. For example the gas valve can be fixedly connected to a valve cone, wherein a displacement of the gas valve leads to a lifting of the valve cone out of the valve seat, or a lowering of the valve cone into the valve seat.

BRIEF DESCRIPTION OF THE FIGURES

Further embodiments and aspects of the invention are more fully explained by the description below of the figures.

DETAILED DESCRIPTION

Examples of embodiments are described below with the aid of the figures. In the figures, elements which are identical or similar, or have identical effects, are designated with identical reference signs. In order to avoid redundancy, repeated description of these elements is in part dispensed with in the description below.

Figure 1:
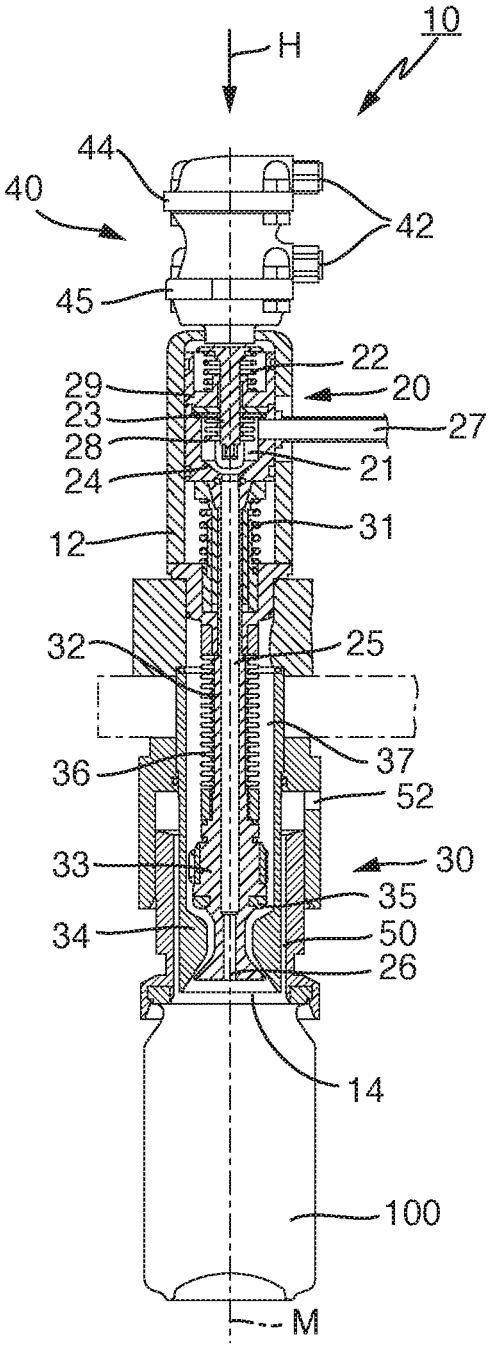
FIG. 1 is a schematic sectional view of a filling element with a double-stroke actuator, wherein a gas valve and a filling valve are in an open switch state.

FIG. 1 shows a device 10 for filling a container with a carbonated filling product in a beverage filling system, wherein a gas valve 20 and a filling valve 30 are accommodated in a valve housing 12. The gas valve 20 and the filling valve 30 are operatively connected with each other via a gas valve spring 22 and a filling valve spring 31 such that, by means of an actuator 40 which is disposed above the valve housing 12, the gas valve 20 and/or the filling valve 30 can adopt an open or closed switch state, depending on the switch state of the actuator 40.

The actuator 40 shown in FIG. 1 is disposed above the valve housing 12, and is in the form of a pneumatic double-stroke actuator which has a first linear actuator 44 and a second linear actuator 45. The first linear actuator 44 and the second linear actuator 45 can be pressurized with compressed air via compressed air connections 42. The first linear actuator 44 can thus execute a first forward stroke in the stroke direction H. The second linear actuator 45 can provide a second forward stroke in the stroke direction H. The stroke direction H, which can be actively applied by the actuator 40, is here in the direction of closing of both the gas valve 20 and the filling valve 30.

The gas valve 20 is disposed in the upper region of the valve housing 12. The gas valve 20 is mounted in a gas valve guide 29, which is disposed in the valve housing 12 such that it is displaceable along a middle axis M of the device 10. The gas valve 20 comprises a gas valve closing part 23, which is guided in the gas valve guide 29, and which is biased in an open switch state of the gas valve 20 by means of a gas valve spring 22. The gas valve spring 22 is supported for this purpose on the gas valve guide 29. The gas valve closing part 23 and the gas valve spring 22 are disposed concentric with each other along the middle axis M of the device 10.

In the switch state of the gas valve that is shown in FIG. 1, the gas valve closing part 23 is lifted out of its gas valve seat 24, so that the gas valve 20 is in an open switch state. The gas valve 20 has a gas valve chamber 21, into which the gas valve closing part 23 protrudes, and which is bounded in a lower region by the gas valve seat 24. The gas valve chamber 21 is bounded in an upper region, and circumferentially at its sides, by the gas valve guide 29. In order that the gas valve closing part 23 can move in the gas valve chamber 21 relative to the gas valve seat 24, the gas valve closing part 23 is sealed via a gas valve bellows 28 against the gas valve guide 29.

A gas supply line 27 discharges from the side into the gas valve chamber 21, supplying for example a gas that is drawn from a filling product reservoir above a fill product.

A filling valve stem 32 extends downwards from the gas valve seat 24 concentrically to the middle axis M of the device 10. The lower portion of the filling valve stem 32 thereby forms a filling valve cone 33 of the filling valve 30. The filling valve stem 32 is penetrated throughout by a concentrically disposed bore, which forms a gas line 25 and, in the open switch state shown in FIG. 1, connects the gas valve chamber 21 with the filling product outlet aperture 14 of the device 10. Accordingly it is possible, in the open switch state of the gas valve 20, to feed a gas via the gas line 25 to a container 100 to be filled which is disposed below the device 10, and which is for example pressed in a gas-tight manner into a centering bell.

In an upper region of the filling valve stem 32, a filling valve spring 31 is provided, which is concentrically disposed around the filling valve stem 32 and which is braced against a protrusion of the filling valve stem 32 and a protrusion of the valve housing, in order to bias the filling valve stem 32 together with the filling valve cone 33 in the opposite direction to the stroke direction H in an open switch state of the filling valve. In the switch state of the filling valve 30 that shown in FIG. 1, the filling valve cone 33 is thus lifted out of its filling valve seat 34.

The filling valve cone 33 is disposed in a valve interior space 37 which is in fluid communication with a filling product reservoir. At its top, the filling valve cone 33 is sealed against the valve housing 12 by means of a filling valve bellows 36. In the switch state of the filling valve that is shown in FIG. 1, a filling product in the valve interior space 37 can flow through the annular gap formed between the filling valve cone 33 and the filling valve seat 34, and exit the device 10 in the region of the filling product outlet aperture 14 for filling a container 100 that is to be filled.

As an alternative or in addition to the use of the filling valve bellows 36 that is described above, a metal or Teflon membrane can be advantageously used to seal the stroke.

Figure 2:
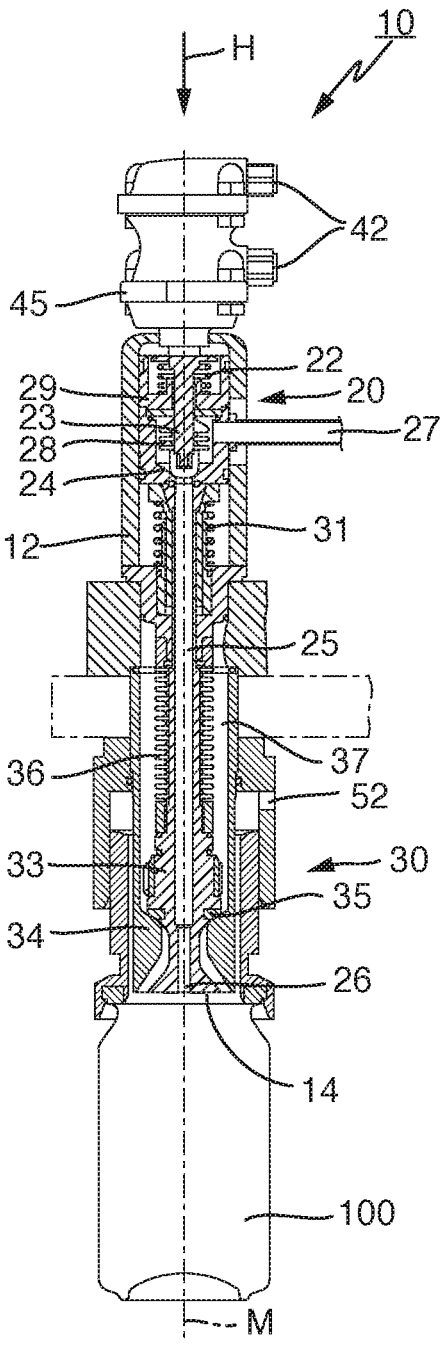
FIG. 2 is a schematic sectional view of the filling element from FIG. 1, wherein the gas valve and the filling valve are in a closed switch state.

The gas valve spring 22 that is shown in FIGS. 1 and 2 has a greater spring constant than the filling valve spring 31. Thus the spring force exerted by the gas valve spring 22 is greater than the spring force exerted by the filling valve spring 31. If the actuator 40 executes a first forward stroke, the gas valve closing part 23 is thereby displaced downwards in the stroke direction H by the stroke length of the first forward stroke. Due to its greater spring constant, the gas valve spring 22 undergoes no deformation as a result of the first forward stroke. Instead, the gas valve spring 22 displaces the gas valve guide 29 downwards by the stroke length of the first forward stroke. By this means the filling valve stem 32, which is disposed underneath the guide 29 and attached to it, is also displaced downwards, which leads to a deformation of the filling valve spring 31 and simultaneously to a lowering of the filling valve cone 33 into the filling valve seat 34.

In this switch state of the actuator 40, the gas valve 20 is open and the filling valve 30 is closed. Accordingly, it is possible for example to carry out a rinsing operation or the pre-pressurization with a gas of a container 100 to be filled which is disposed on the device 10.

If the actuator 40 executes a second forward stroke, the gas valve closing part 23 is displaced downwards by the stroke length of the second forward stroke. Because in this state the filling valve cone 33 is already accommodated in a sealing manner in the filling valve seat 34, the filling valve stem 32, and hence the gas valve guide 29, cannot be displaced further downwards, with the result that the second forward stroke of the actuator 40 leads to a deformation of the gas valve spring 22, which is accompanied by a lowering of the gas valve closing part 23 into the gas valve seat 24.

If a second forward stroke of the actuator 40 is executed, the switch states of the gas valve 20 and the filling valve 30 that result are those shown in FIG. 2, wherein both the gas valve 20 and the filling valve 30 are closed.

If the actuator 40, starting from the switch states of the gas valve 20 and the filling valve 30 that are shown in FIG. 2, executes a first return stroke in a direction opposite to the stroke direction H, this leads initially to a deformation of the gas valve spring 33, which causes the gas valve closing part 23 to be lifted out the gas valve seat 24. Thus, by means of the second forward stroke and the first return stroke, the gas valve 20 can be closed and opened, while the filling valve 30 remains in a closed switch state.

If the actuator 40 executes a second return stroke after the first return stroke is completed, a deformation of the filling valve spring 31 causes the gas valve guide 29 to displace upwards, which lifts the filling valve cone 33 out of the filling valve seat 34, so that the switch state of the gas valve 20 and the filling valve 30 that is shown in FIG. 1 is reached.

Figure 3:
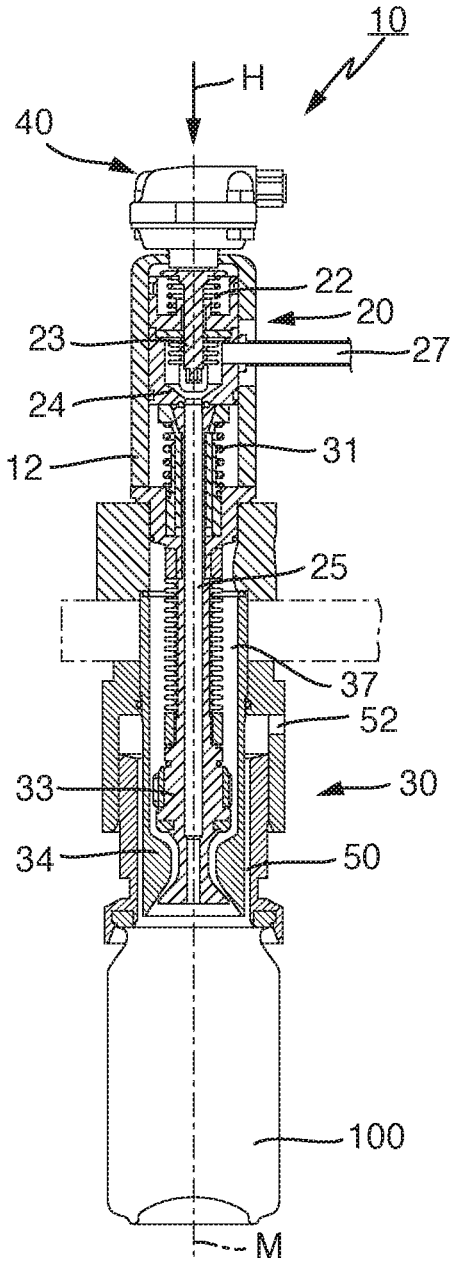
FIG. 3 is a schematic sectional view of a filling element with a single-stroke actuator, wherein a gas valve and a filling valve are in an open switch state.

FIG. 3 shows a device 10 for filling a container with a carbonated filling product in a beverage filling system, which, in contrast to the device shown in FIGS. 1 and 2, has an actuator 40 in the form of a pneumatic single-stroke actuator. By means of the pneumatic single-stroke actuator, it is possible to produce a single forward stroke and a single return stroke.

If the actuator 40 executes a forward stroke in the stroke direction H, the gas valve closing part 23 is lowered in a sealing manner into the gas valve seat 24, by means of which the gas valve 20 adopts a closed switch state. In addition, the forward stroke of the actuator 40 causes the valve cone 33 to be lowered into the valve seat 34, thus also switching the filling valve 30 to a closed switch state.

Figure 4:
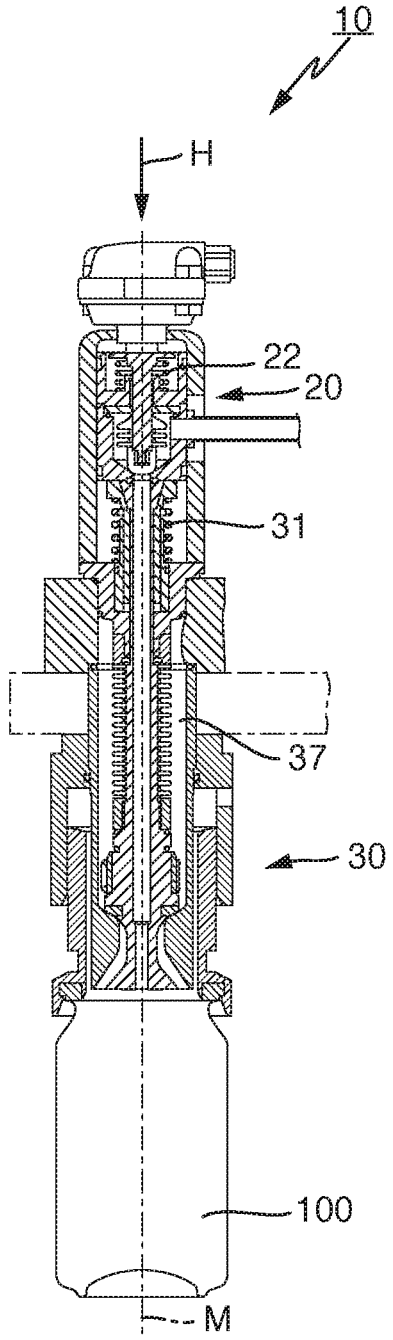
FIG. 4 is a schematic sectional view of the filling element from FIG. 3, wherein the gas valve and the filling valve are in a closed switch state.

Accordingly, following the forward stroke of the actuator 40, both the gas valve 20 and the filling valve 30 are in a closed switch state, as shown in FIG. 4. If the actuator 40 executes a return stroke in the direction opposite to the stroke direction H, the gas valve spring 22 lifts the gas valve closing part 23 out of the gas valve seat 24, by which means the gas valve adopts an open switch state.

The filling valve spring 31, whose spring force slightly exceeds the total force of the weights of the filling valve cone 33 and the gas valve 20, is thereby able to lift the filling valve cone 33 out of the filling valve seat 34 after the return stroke of the actuator 40, if the same conditions, and in particular the same pressures, obtain in the valve interior space 37 and at the filling product outlet aperture 14. Accordingly, after a return stroke the device 10 can again adopt the switch states of the gas valve 20 and the filling valve 30 that are shown in FIG. 3.

If, however, following a forward stroke of the actuator 10, after which the filling element has adopted the switch states of the gas valve 20 and the filling valve 30 that are shown in FIG. 4, an overpressure exists in the valve interior space 37 relative to the pressure obtaining below the filling product outlet aperture 14, for example because the valve interior space 37 is pressurized by the filling product, which is under pressure, the filling valve spring 31 is not able to lift the filling valve cone 33 out of the filling valve seat 34 after completion of the return stroke of the actuator 40, due to the pressure gradient that then exists in the direction of closing. The overpressure in the valve interior space 37 thus presses the filling valve cone 33 against the filling valve seat 34. The filling valve 30 is thus prevented from opening by the overpressure prevailing in the valve interior space 37, even if the return stroke has already brought about the opening of the gas valve 20.

If a container that is to be filled is now attached under the filling product outlet aperture 14 of the device 10 in a gas-tight manner, for example by means of a centering bell, a rinsing gas can initially flow through the gas line 25 into the container in an open switch state of the gas valve 20. The rinsing gas is, in various embodiments, supplied from the gas space above the filling product in a filling product reservoir.

Radially outside the filling product outlet aperture 14, and concentric with it, an annular rinsing channel 50 is disposed, which is connected via a drilled rinsing hole 52 with a rinsing valve, which is not shown. During a rinsing process, the gas which flows from the gas line 25 into the container can flush the container that is to be rinsed, and be guided out through the rinsing hole 52 via the rinsing channel 50.

If the rinsing valve is closed and the flow of gas into the container through the gas line 25 is maintained, the pressure in the container rises to the level of the pressure in the valve interior space 37, which is also in fluid communication with the filling product reservoir. If the same pressure obtains below the filling valve cone 33, in the interior of the container, and in the valve interior space 37, the filling valve cone 33 is no longer held in the filling valve seat 34, the pressure gradient is removed, and the filling valve spring 31 can lift the filling valve cone 33 out of the filling valve seat 34, provided that the actuator 40 has completed the return stroke. When the filling valve spring 31 has lifted the filling valve cone 33 out of the filling valve seat 34, the switch states of the gas valve 20 and the filling valve 30 are again those shown in FIG. 3.

Figure 5:
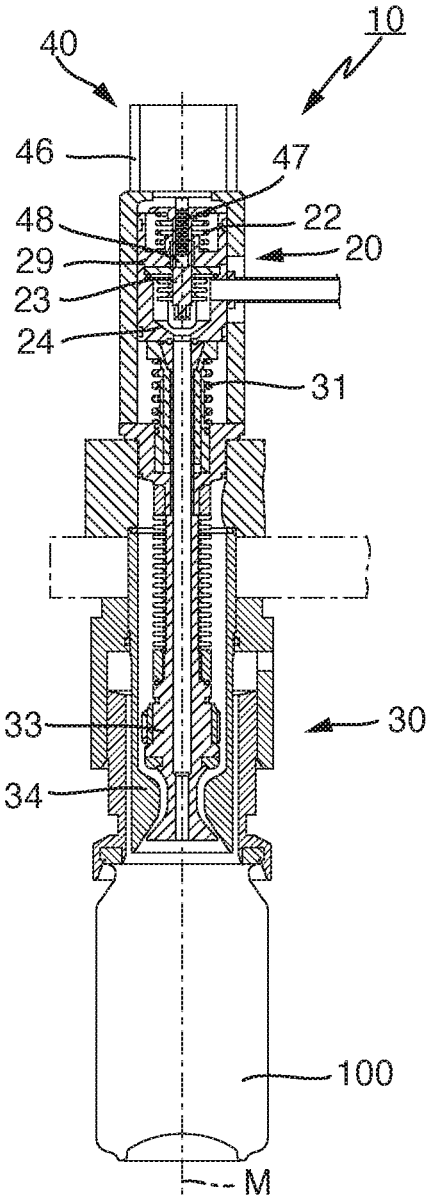
FIG. 5 is a schematic sectional view of a filling element with a proportional actuator, wherein a gas valve and a filling valve are in an open switch state.
Figure 6:
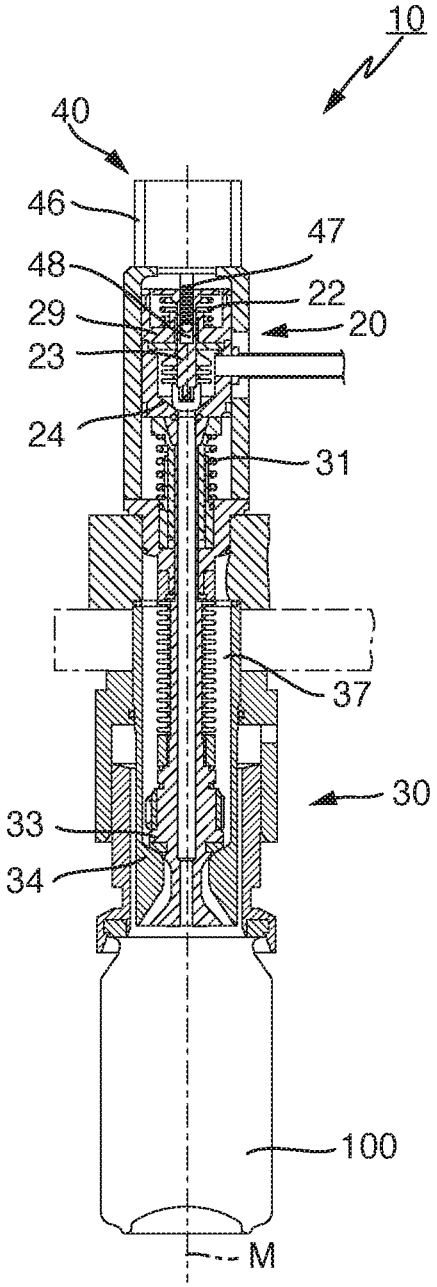
FIG. 6 is a schematic sectional view of the filling element from FIG. 5, wherein the gas valve and the filling valve are in a closed switch state.

FIGS. 5 and 6 show a device 10 for filling a container with a carbonated filling product in a beverage filling system, which has an actuator 40 in the form of a proportional actuator, which is itself in the form of a spindle actuator. The actuator 40 has a motor 46, which is disposed on an upper side of the valve housing 12. The motor 46 is, in some embodiments, a stepper motor, by means of which a specified rotational position can be reproducibly reached.

A spindle 47 extends coaxially with the middle axis M of the device 10, from the motor 46 downwards into the gas valve 20. The spindle 47 is rotatably accommodated in a threaded hole 48 which is disposed in, and concentric with, the gas valve closing part 23. The gas valve closing part 23 is secured against rotation in the gas valve guide 29. The gas valve closing part 23 can thereby be displaced upwards and downwards according to the direction of rotation of the spindle 47.

By this means it is possible to switch the gas valve 20 and the filling valve 30 steplessly or stepwise from a fully open switch state to a fully closed switch state. Switch states are thereby also possible in which the gas valve 20 and the filling valve 30 are only partially open. In the case of the gas valve 20, this means that the flow of gas supplied to the container can be adjusted.

In the case of the filling valve 30, it is possible to adapt the flow rate of the filling product to the different phases of filling. Thus at the beginning of the filling process the filling valve cone 33 can be lifted only slightly out of the filling valve seat 34, in order to enable the initial filling of the container to take place slowly. Subsequently the filling valve cone 33 can be lifted further out of the filling valve seat 34, in order to increase the flow rate at which the filling product flows into the container. In the last phase of the filling process, the filling valve cone 33 can be brought back closer to the filling valve seat 34, in order to provide slow filling as a maximum fill height, or a cutoff condition, is approached.

The proportional spindle actuator shown in FIGS. 5 and 6 can be combined with the filling elements shown in FIGS. 1 to 4.

To the extent applicable, all individual features described in the individual example embodiments can be combined with each other and/or exchanged, without departing from the field of the invention.

The invention claimed is:

1. A device for filling a container with a carbonated filling product in a beverage filling system, comprising:

a gas valve configured to supply a gas into the container, wherein the gas valve is biased by a gas valve spring in a specified switch state and the gas valve spring biases the gas valve in an open switch state; and a filling valve configured to supply the carbonated filling product into the container, wherein the filling valve is biased by a filling valve spring in a specified switch state and the filling valve spring biases the filling valve in the open switch state, wherein the gas valve and the filling valve are operatively connected to a single actuator configured to switch the gas valve and the filling valve between the open switch state and a closed switch state, and wherein the gas valve spring applies a spring force which is greater than a spring force applied by the filling valve spring.

2. The device of claim 1, wherein the gas valve and the filling valve are mechanically connected in series.

3. The device of claim 1, wherein the single actuator comprises a double-stroke actuator.

4. The device of claim 3, wherein the double-stroke actuator comprises a pneumatic double-stroke actuator.

5. The device of claim 3, wherein a first return stroke of the double-stroke actuator opens the gas valve fully.

6. The device of claim 1, wherein the single actuator comprise a single-stroke actuator.

7. The device of claim 6, wherein the single-stroke actuator comprises a pneumatic single-stroke actuator.

8. The device of claim 1, wherein the spring force applied by the filling valve spring is greater than a force of a weight of a filling valve cone of the filling valve.

9. The device of claim 1, wherein the single actuator comprises a proportional actuator.

10. The device of claim 9, wherein the proportional actuator comprises a spindle actuator.

11. A device for filling a container with a carbonated filling product in a beverage filling system, comprising:

a gas valve configured to supply a gas into the container, wherein the gas valve is biased by a gas valve spring in a specified switch state and the gas valve spring biases the gas valve in an open switch state;

a filling valve configured to supply the carbonated filling product into the container, wherein the filling valve is biased by a filling valve spring in a specified switch state and the filling valve spring biases the filling valve in the open switch state; and a filling product outlet aperture disposed at an outlet of the filling valve, wherein the gas valve and the filling valve are operatively connected to a single actuator configured to switch the gas valve and the filling valve between the open switch state and a closed switch state, and the gas valve spring applies a spring force which is greater than a spring force applied by the filling valve spring.

12. The device of claim 11, wherein the filling product outlet aperture is in fluid communication with a rinsing valve via a rinsing channel configured to rinse the container with a rinsing gas.

13. The device of claim 11, wherein the gas valve is displaceably disposed relative to a filling valve seat configured to close the filling valve.

14. The device of claim 11, wherein the gas valve spring and the filling valve spring have differing spring constants and/or differing preloads.

15. The device of claim 11, wherein the gas valve spring and/or the filling valve spring has at least two spring components.

16. The device of claim 11, wherein the gas valve and the filling valve are mechanically connected in series.

17. The device of claim 11, wherein the single actuator comprises a pneumatic double-stroke actuator, a pneumatic single-stroke actuator, or a spindle actuator.

* * * * *